United States Patent [19]

Holle et al.

[11] 4,202,999

[45] May 13, 1980

[54] FUSED SILICA LAMP ENVELOPE AND SEAL

[75] Inventors: Robert F. Holle, South Euclid; Richard L. Hansler, Pepper Pike, both of Ohio

[73] Assignee: General Electric Company, Schenectady, N.Y.

[21] Appl. No.: 895,433

[22] Filed: Apr. 11, 1978

[51] Int. Cl.[2] ..... H01J 5/36

[52] U.S. Cl. ..... 174/50.61; 29/25.13; 313/317

[58] Field of Search ..... 174/50.57, 50.58, 50.61, 174/50.64, 152 GM; 313/317, 318; 29/25.1, 25.13

[56] References Cited

U.S. PATENT DOCUMENTS

| | | | |
|---|---|---|---|
| 2,135,661 | 11/1938 | Hagen et al. | 174/50.61 X |
| 2,245,394 | 6/1941 | Francis et al. | 174/50.58 |
| 2,276,218 | 3/1942 | Lemmens . | |
| 2,316,999 | 4/1943 | Spencer . | |
| 2,319,691 | 5/1943 | Koch et al. | 174/50.58 X |
| 2,891,202 | 6/1959 | Geissinger et al. | 174/152 GM |

*Primary Examiner*—Bruce A. Reynolds
*Assistant Examiner*—D. A. Tone
*Attorney, Agent, or Firm*—Ernest W. Legree; Lawrence R. Kempton

[57] ABSTRACT

A seal into a fused silica envelope comprises a refractory metal wire extending through an aperture in a fused silica neck leading into the envelope. A bead of glass having a coefficient of expansion intermediate those of the refractory metal and of the fused silica is formed around and wets the wire inlead. A hermetic seal is achieved by causing fused silica from the neck to shrink around the bead and be wetted by it, forming an annular sealing zone spaced out from the wire inlead. The wire may be of tungsten in which case the electrode and inlead may be of one piece without a joint.

14 Claims, 3 Drawing Figures

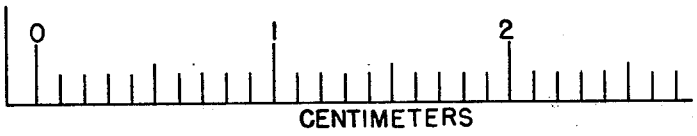
Fig. 1
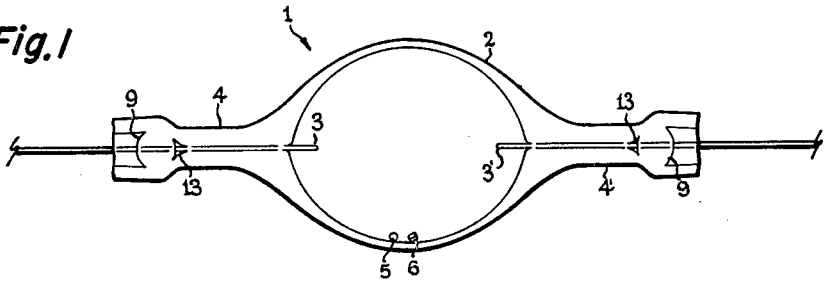
Fig. 2
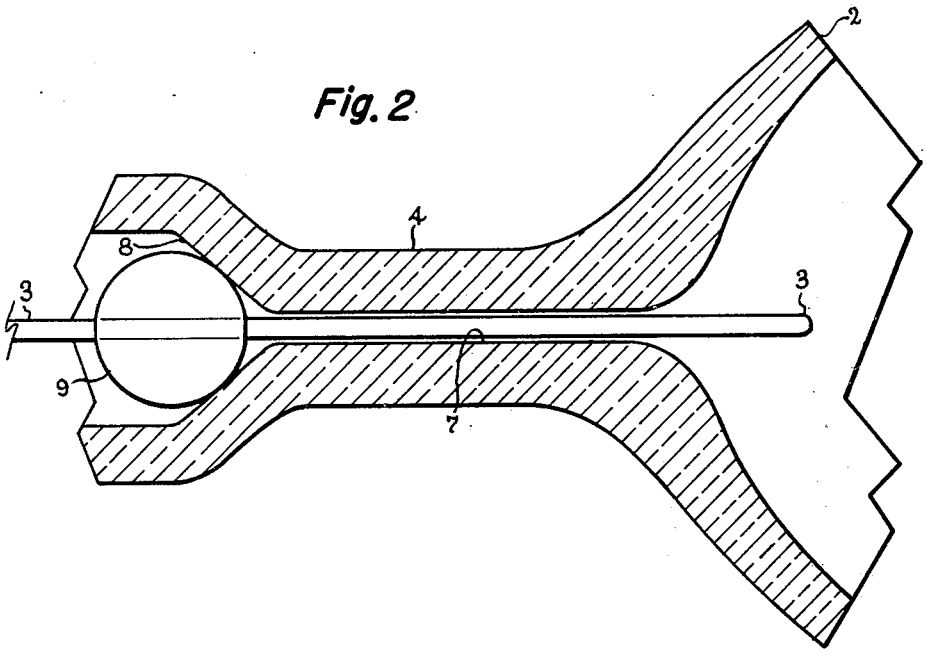
Fig. 3
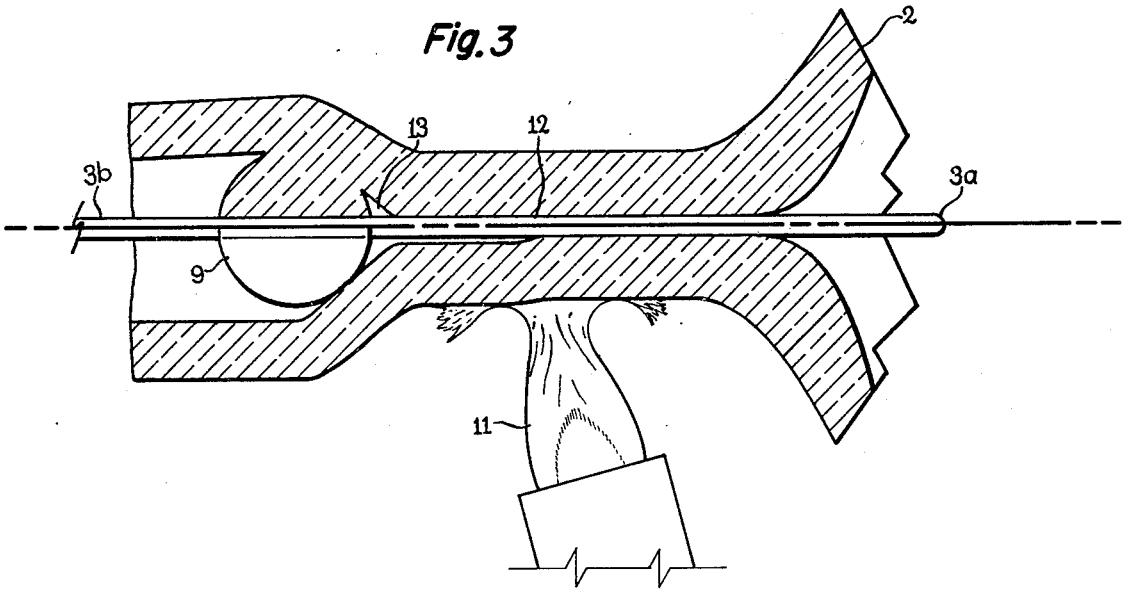

FUSED SILICA LAMP ENVELOPE AND SEAL

The invention relates to an inlead seal suitable for wire sizes generally used in lamp making, from about 1 mil up to 50 mils, but particularly suitable for use in metal vapor discharge lamps having very small discharge volumes such as about one cubic centimeter or less and the correspondingly fine inleads used in such miniature lamps.

BACKGROUND OF THE INVENTION

In copending applications Ser. No. 812,479, filed July 5, 1977 by Daniel M. Cap and William H. Lake, entitled Higher Pressure Metal Vapor Discharge Lamps Improved in Efficiency, and Ser. No. 845,738, filed Oct. 26, 1977 by Elmer G. Fridrich, titled Miniature High Pressure Discharge Lamps, both assigned like this application, useful and efficient high pressure discharge lamps are disclosed having much smaller sizes than have been considered practical heretofore, namely discharge volumes of 1 cubic centimeter or less. In preferred form achieving maximum efficacy, these high intensity lamps utilize generally spheroidal thin-walled arc chambers together with vapor pressures above 5 atmospheres and reaching progressively higher levels as the size is reduced. The convective arc instability usually associated with the high pressures utilized is avoided and there is no appreciable hazard from possibility of explosion. Practical designs provide wattage ratings or lamp sizes starting at about 100 watts and going down to less than 10 watts, the lamps having characteristics including color rendition, efficacy, maintenance and life duration making them suitable for general lighting purposes.

In order to have high efficacy with a miniature metal vapor lamp, it is necessary for its electrodes to attain the required temperatures for good electron emission even at the low energy inputs involved. An important factor in achieving this result is reduction of the physical size of the electrodes and inleads in order to reduce the heat loss from them. In copending application Ser. No. 824,557, filed Aug. 15, 1977, by Richard L. Hansler, titled "Electrode Inlead for Miniature Discharge Lamps", now U.S. Pat. No. 4,136,298, January 1979, a small size electrode inlead assembly is described comprising a small tungsten pin joined on axis to a fine molybdenum wire having a foil portion for sealing through fused silica. The join in that assembly is effected by a laser butt weld which permits a symmetric compact seal making possible a very small discharge envelope having minimum end losses.

SUMMARY OF THE INVENTION

The object of the invention is to provide a new inlead seal assembly of simple construction which is particularly adapted to use with miniature discharge lamps in order to reduce electrode heat losses.

In accordance with out invention a seal into a fused silica envelope comprises a refractory metal wire inlead extending through an aperture in a fused silica neck leading into the envelope. A bead of glass having a coefficient of thermal expansion intermediate those of the refractory metal and of the fused silica is formed around and wets the wire. A hermetic seal is achieved by heating the region of the bead sufficiently to cause the glass to melt and wet the fused silica in an annular sealing zone spaced out from the wire inlead.

In a preferred embodiment the wire is of tungsten and this allows the electrode and the inlead to be of one piece without a joint.

DESCRIPTION OF DRAWING

In the drawing:

FIG. 1 illustrates, to the scale shown above the figure, a miniature metal vapor discharge lamp or arc tube in which seals embodying the invention are utilized.

FIG. 2 is an enlarged fragmentary view showing a refractory wire lead with a glass bead formed around it, the lead being in place for sealing within the fused silica neck of the envelope.

FIG. 3 is a view similar to FIG. 2 split along the centerline of the inlead, the lower half showing the heated neck in process of shrinking onto the inlead and bead, and the upper half showing the end result.

DETAILED DESCRIPTION

Referring to FIG. 1, an arc tube 1 in which the invention is embodied comprises a generally spherical arc chamber portion 2 into which tungsten pin or wire electrodes 3, 3' project through neck portions 4, 4'. The arc tube or bulb may be formed from quartz or fused silica tubing, including leached high silica glasses which behave essentially like fused silica, such as those containing better than 95% silica and known under the trademark "Vycor". One way to make the bulb is to heat the tubing to plasticity in controlled regions while revolving it in a double chuck glass lathe: the arc chamber portion is formed by the expansion and upset of the tubing while pressurized; the neck portions are formed by collapse or shrinkage of the tubing. Heat is enough to cause the tubing to shrink but it may be helped along by reducing the pressure if desired.

Arc tube 1 is typical of the discharge envelope proper of a miniature metal halide lamp. As illustrated, the wall thickness of the bulb portion is about 0.5 mm, the internal diameter is about 6 mm, and the arc chamber volume is approximately 0.11 cc. An arc tube of this size may have a rating of about 30 watts and a suitable filling therefor comprises argon at a pressure of 100 to 120 torr, 4.3 mg of Hg and 2.2 mg of halide salt consisting of 85% NaI, 5% $ScI_3$ and 10% $ThI_4$ by weight. Such quantity of mercury, when totally vaporized under operating conditions, will provide a density of about 39 $mg/cm_3$ which corresponds to a pressure of about 23 atmospheres at the operating temperature of the lamp. The mercury is shown in FIG. 1 as a globule 5, and the halide salt as a pellet 6. They may be introduced into the arc chamber portion through one of the necks before sealing in the second electrode, in which case the arc chamber portion is chilled during the heat sealing of the neck to prevent vaporization of the charge. Alternatively, the charge may be introduced through an auxiliary exhaust tube after the electrodes have been sealed in, and the exhaust tube (not shown) is then eliminated by tipping off. The illustrated mercury globule and halide pellet vaporize when the lamp is first operated; upon subsequent cooling the charge condenses as a coating on the arc chamber walls.

Referring to FIG. 2, an electrode inlead seal particularly suitable for a miniature metal vapor lamp utilizing tungsten wire inleads in the range of 4 to 10 mils is made as follows. When the quartz bulb was formed, a neck 4 was provided having a hole or passage 7 through it larger than the wire inlead 3 over a length of several millimeters. Beyond, the hole is larger than the bead and the neck may flare out to the original tubing dimensions as indicated at 8. The neck is made long enough to locate the bead at some distance from the bulb. If the glass bead is sealed into the quartz too close to the bulb it may soften during operation of the lamp.

Prior to inserting the tungsten inlead into the neck, a small bead 9 of glass is formed on the tungsten wire. A glass is used having a coefficient of thermal expansion intermediate that of tungsten and of fused silica. One suitable glass is Corning glass No. 7230 having an expansion coefficient of about $1.4\times10^{-6}$ per °C., which compares with tungsten at $4.5\times10^{-6}$ and quartz at $0.45\times10^{-6}$. Other suitable glasses are the General Electric Company series GSC 1 to 3. A suitable method of forming the bead on the wire which assures wetting of the tungsten by the glass is to heat the wire in an inert atmosphere by the passage of current through it and to melt the glass onto the hot wire. It is desirable to have the bead diameter appreciably greater than the wire inlead diameter, 3 times or more. For example with the illustrated inlead which is 8 mil tungsten wire, a bead of 40 mils diameter was used. This permits some radial distance or annular separation between the point where the glass is sealed to the silica and the point where it is sealed to the inlead.

To make the seal, the beaded wire inlead is inserted into the neck and argon flushing gas may be used to force the bead into the throat of the flare. The seal is completed by heating the quartz neck, suitably by means of a sharp gas flame indicated at 11 in FIG. 3, starting with the flame next to the bulb and moving out towards the glass bead. The entire assembly is of course revolving in a glass lathe while heat is being applied. Sufficient heat is applied to soften the quartz or fused silica and to cause it to shrink slightly in diameter, as indicated at 12, and to contract around the tungsten inlead 3 but without sealing or wetting to it. However in the region of the glass bead, the glass melts enough to wet the quartz as the latter contracts about the bead. This assures a hermetic seal inasmuch as there is wetting between glass and tungsten inlead and between glass and quartz surrounding it.

The heating is controlled to maintain an annular gap or crevice 13 around the inlead between the sealing zone of quartz to glass, and the sealing zone of glass to metal inlead. We have found the presence of such a crevice necessary for a reliable seal. In other words, the heating is restrained to avoid a complete collapse of the quartz against the inlead next to the glass bead which would obliterate crevice 13 on the bulb side of the glass bead. The annular crevice 13 may fill with inert gas or with some of the mercury and metal halide charge during the life of the lamp; however it is small enough that this creates no problem from the point of view of changing the amount of the effective charge in the bulb.

A lamp corresponding dimensionally to that illustrated in FIG. 1 and having a seal such as illustrated in FIG. 3 was operated at 31 watts input and showed an initial efficiency of 86 lumens per watt. The hermetic seal withstood the alternate heating and cooling of switching on and off without any sign of strain or deterioration.

The electrodes of high intensity metal vapor or metal halide arc lamps have to be made of tungsten. An advantage of the seal according to the invention is that it permits a single length of tungsten wire without any joint or weld in it to be used both for the inlead and for the electrode, or at least the electrode shank. However in some instances it is desirable to have the externally projecting portion of the inlead of some other material than tungsten in order to facilitate making connections to it. For instance it might be desirable to have the portion 3*a* of the inlead, as shown in FIG. 3, projecting into the arc chamber made of tungsten, and portion 3*b* projecting externally, of molybdenum. In such case a joint is effected between the two portions, for instance by a laser weld on axis as taught in the previously mentioned copending application of Richard L. Hansler. The joint could then be located within the hole or passage 7 through neck portion 4, and a seal is made by means of a glass bead between the molybdenum outer portion and the neck. Such a modified construction retains the advantage, made possible by this invention, of eliminating the need for a foliated or flattened section in the molybdenum portion with which to effect a hermetic seal.

What we claim as new and desire to secure by Letters Patent of the United States is:

1. An inlead seal assembly comprising:
   - a fused silica neck extending into a bulb portion and including a passageway therethrough,
   - a refractory metal wire inlead extending through the passageway into the bulb portion,
   - a glass bead formed around said wire inlead with wetting, the glass of said bead having a coefficient of expansion intermediate those of the refractory metal and of fused silica,
   - the silica of the neck being collapsed around said wire inlead without wetting substantially from the bulb portion out to said glass bead, and being engaged by said glass bead with wetting of the fused silica by the glass in order to achieve a hermetic seal, the wetting engagement of glass and fused silica forming a sealing zone concentric with said hermetic seal, and an annular crevice being left between the glass bead and the silica neck on the side of the bulb portion.

2. A seal assembly as in claim 1 wherein the diameter of the annular crevice is no less than double the inlead diameter.

3. A seal assembly as in claim 1 wherein the diameter of the glass bead is at least three times the inlead diameter.

4. A seal assembly as in claim 1 wherein the wire inlead extending through the neck is one piece of tungsten wire.

5. A seal assembly as in claim 1 wherein the wire inlead extending through the neck comprises a tungsten portion extending into the bulb portion and a portion of some other metal reaching to the outside, the two portions being joined together on axis.

6. A miniature high pressure metal vapor discharge lamp comprising:
   - a thin-walled fused silica envelope defining a bulb portion not exceeding approximately 1 cubic centimeter in volume and having a neck portion with a passageway therein through which extends a fine refractory metal wire inlead,
   - said inlead having a glass bead formed therearound with wetting, said bead being of a glass having a coefficient of thermal expansion intermediate that of said refractory metal and that of fused silica,
   - the silica of the neck being collapsed around said wire inlead without wetting substantially from the bulb portion out to said glass bead, and the glass bead engaging the fused silica of the neck with wetting all around in order to achieve a hermetic seal, the wetting engagement of glass and fused silica forming a sealing zone concentric with said hermetic seal, and an annular crevice being left between the glass bead and the silica neck on the side of the bulb portion.

7. A lamp as in claim 6 wherein the inlead diameter is from 4 to 10 mils.

8. A lamp as in claim 6 wherein the diameter of the annular crevice is no less than double the inlead diameter.

9. A lamp is in claim 6 wherein the diameter of the glass bead is at least three times the inlead diameter.

10. A lamp as in claim 6 wherein the wire inlead extending through the neck is one piece of tungsten wire.

11. A lamp as in claim 6 wherein the wire inlead extending through the neck comprises a tungsten portion extending into the bulb portion and a portion of some other metal reaching to the outside, the two portions being joined together on axis.

12. The method of sealing an inlead into a fused silica envelope comprising:

making an envelope of fused silica having a bulb portion and a neck portion joined thereto through which extends a passageway dimensioned to accommodate a metal inlead of a given diameter over a certain length and flaring out to a greater diameter beyond said length, forming a glass bead with wetting around an inlead of said given diameter, said glass having a coefficient of expansion intermediate fused silica and said inlead, inserting said inlead into said passageway up to said glass bead, and heat-collapsing the fused silica of said neck portion around said inlead without wetting it from the bulb portion out to said glass bead, and around said glass bead with wetting of the fused silica by the glass to achieve a hermetic seal, the wetting engagement of glass and fused silica being in a sealing zone concentric with said hermetic seal, and an annular crevice being left between the glass bead and the silica neck on the side of the bulb portion.

13. The method of claim 12 wherein the annular crevice is formed to a diameter no less than double the inlead diameter.

14. The method of claim 12 wherein the diameter of the glass bead to which wetting engagement is made is at least three times the inlead diameter.

* * * * *